United States Patent [19]

Granger et al.

[11] Patent Number: 5,056,418

[45] Date of Patent: Oct. 15, 1991

[54] SELF-ADJUSTING AUTOMATIC LOCKING PISTON FOR RAM BLOWOUT PREVENTERS

[76] Inventors: Stanley W. Granger, 23800 Gold Nugget, Diamond Bar, Calif. 91765; Joseph O. Beard, 1625 N. Lincoln Ave., Fullerton, Calif. 92631; Frode Sveen, 12697 Orgren Ave., Chino, Calif. 91710

[21] Appl. No.: 600,314

[22] Filed: Oct. 18, 1990

[51] Int. Cl.[5] ..... F15B 15/26; E21B 33/06

[52] U.S. Cl. ..... 92/24; 92/15; 92/27; 251/1.1

[58] Field of Search ..... 92/15, 18, 19, 20, 23, 92/24, 25, 27, 28; 251/1.1, 1.2, 1.3

[56] References Cited

U.S. PATENT DOCUMENTS

| | | | |
|---|---|---|---|
| 3,050,943 | 8/1962 | Thorel et al. | 92/23 X |
| 3,107,582 | 10/1963 | Royster | 92/24 |
| 3,350,987 | 11/1967 | Johnson | 92/27 X |
| 3,420,144 | 1/1969 | Berry | 92/24 X |
| 3,534,621 | 10/1970 | D'Ascenzo | 92/15 X |

*Primary Examiner*—Edward K. Look
*Assistant Examiner*—John Ryznic
*Attorney, Agent, or Firm*—William L. Chapin

[57] ABSTRACT

An improved self-locking piston for use in ram blowout preventers has a hollow cylindrical outer piston which slidably contains an inner locking piston. The inner locking piston has a tapered, frusto-conically shaped front section with a plurality of circumferentially spaced apart, sloping flats formed therein. Apertures provided through the outer wall surface of the main outer piston contain radially slidable driver segments each having a sloping surface complementary to the sloping surface of the flats on the inner piston. Forward motion of the inner piston relative to the outer piston forces the driver segments radially outwards in the apertures. A plurality of locking segments, one each positioned in a groove rearward of and communicating with a separate one of each of the apertures is provided. Each locking segment has a sloping lower front surface adapted to sliding engagement by the sloping upper rear surface of a driver segment. Outward radial motion of the driver segments causes the locking segments to move into locking engagement with an annular groove provided in the inner wall surface of the ram cylinder. Each rear locking segment groove is longer than that of the rear portion of a locking segment. Thus, locking segments may move rearward in their grooves, permitting forward motion of the inner piston, outer piston, piston rod, and ram sealing element to compensate for ram rubber wear while still maintaining the ram sealing element firmly locked in its forward-most sealing position.

13 Claims, 5 Drawing Sheets

SELF-ADJUSTING AUTOMATIC LOCKING PISTON FOR RAM BLOWOUT PREVENTERS

BACKGROUND OF THE INVENTION

A. Field of the Invention

The present invention relates to machinery for use in drilling and operating oil and gas wells. More particularly, the invention relates to a particular type of mechanism for preventing pressurized liquids or gases from blowing out and upwards through a well hole in an uncontrolled manner. Such mechanisms are referred to in the industry as ram blowout preventers. Specifically, the invention relates to an improved automatic locking actuator piston for use in ram blowout preventers.

B. Discussion of Background Art

In drilling for natural gas or liquid petroleum, a drill string consisting of many lengths of threaded pipes which are screwed together, and terminated at the lower end of the string by a drill bit cutting head, is used to bore through rock and soil. The drill bit head has a larger diameter than the pipes comprising the drill string above the head. A rotary engine attached to the upper end of the drill string transmits a rotary boring motion to the drill bit head.

During the drilling operation, a specially formulated mud is introduced into an opening in an upper drill pipe. This mud, which generally is of a type having a high specific gravity, flows downwards through the hollow bores of the pipes in the drill string and out through small holes or jets in the drill bit head. Since the drill bit head has a larger diameter than the drill string above it, an elongated annular space is created between the outer walls of the drill string components and the walls of the drilled hole during the drilling process. This annular space permits the mud to flow upwards to the surface. Mud flowing upwards carries drill cuttings, primarily rock chips, to the surface. The mud also lubricates the rotating drill string, and provides a downward hydrostatic pressure which counteracts fluid pressure which might be encountered when the drill string enters subsurface gas pockets, or liquids under pressure.

In normal oil well drilling operations, it is not uncommon to encounter subsurface gas pockets whose pressure is greater than could be counter-balanced solely by the hydrostatic pressure of the elongated annular column of drilling mud. To prevent the explosive and potentially dangerous and expensive release of gas and/or liquid under pressure upwards out through the drilling hole, machines called blowout preventers are used. Blowout preventers are mounted in a pipe casing surrounding a drill hole, near the upper end of the hole.

Typical blowout preventers have resilient sealing means which can be made to tightly grip the outer circumferential surfaces of various diameter drill string components, preventing pressure from subterranean gas pockets from blowing out material upwards along the drill string. Usually, the resilient sealing means of a blowout preventer is designed to move a plurality of sealing elements into forcible contact with one another, when all components of a drill string are removed from the casing. This permits complete shutoff of the well, even with all drill string components removed. Most oil well blowout preventers are remotely operable, typically, by a hydraulic pressure source near the drill hole opening, the pressure source being coupled to a hydraulic actuator cylinder in the blowout preventer via hydraulic lines.

Ram blowout preventers (BOP's) utilize a pair of opposed semicircular blocks driven radially inwards by opposed transverse hydraulic rams towards the periphery of a tubular oil well component extending through a longitudinally disposed bore in the BOP. Each of the semicircular ram blocks contains a semicircular sealing element which has formed in its flat diametrical face a coaxial, semicircular groove adapted to conformally engage the periphery of a tubular component within the bore. The faces of the ram sealing elements usually include resilient elements to seal against one another and with the periphery of the oil well component. The purpose of the resilient elements is to form an effective pressure-tight seal against down-hole pressures, which may be as high as 15,000 psi. The resilience of the sealing elements provide a compressibility which accommodates a relatively small range of possible variation in the diameter of tubular oil well components on which the rams are intended to seal against.

Radial motion of ram sealing elements of ram BOPs is usually effected by diametrically opposed hydraulic piston actuators in opposed hydraulic cylinders located on either side of the BOP. A design requirement for most ram BOPs, particularly those that are used in offshore operations, is that they be fail-safe. Thus, the ram elements must remain in sealing contact with the periphery of tubular well components even if hydraulic pressure fails after actuation of the BOP. To fulfill this fail-safe requirement, most ram BOPs utilize a locking piston which includes locking lugs or "dogs" which move radially outward at the end of a piston stroke. The lugs move radially into an annular groove provided in the cylindrical wall of the hydraulic cylinder, near the front end of the cylinder closest to the ram sealing element. Rearward motion of the ram actuator piston is prevented by abutting contact of the rear surfaces of the locking lugs with a locking shoulder forming the rear transverse wall of the annular groove. Unlocking of the lugs is effected by application of hydraulic pressure to the front side of the piston. This reverse pressure also moves the piston and ram sealing elements to a rearward, unlocked position.

Typical ram blowout preventers having an automatic locking capability have a smaller diameter piston, with a rounded front edge, longitudinally slidably contained within a larger diameter, hollow main hydraulic ram actuator piston. Locking lugs are radially slidably contained within radially disposed slots provided at regular circumferential intervals through the outer cylindrical wall of the main piston. The inner radial ends of the locking lugs are slidably engaged by the rounded front edge of the smaller piston. Closing hydraulic pressure on the rear surface of the large and small pistons moves both pistons forward within the cylinder. Forward motion of the main piston is halted when the sealing element on the end of the ram shaft attached to that piston abuts a fixed object. At this point, the smaller piston moves forward within the main piston until its rounded front face contacts the inner ends of the lugs and moves them radially outwards into locking engagement with the annular groove provided in the forward end of the cylinder wall.

Opening hydraulic pressure applied to the front face of the large and small pistons moves the inner piston rearward with respect to the larger piston, allowing the locking lugs to move radially inwards. Disengagement of the locking lugs from the locking groove permits the main, larger piston to move rearward. Rearward movement of the larger main piston and forward extending ram shaft attached to the main piston pulls the attached ram block and ram sealing element away from the drill string component.

The principles of operation of a ram blowout preventer, as described above are simple and readily understood. Thus, it might be concluded that ram blowout preventers would be simple to construct and operate. In fact, the structure and operation of existing ram blowout preventers causes substantial operational difficulties when they are used in typical oil drilling operations, for reasons which will now be described.

Resilient sealing material, often referred to as a ram rubber, in the face of the ram block sealing elements wears thin after a number of sealing and unsealing cycles. Reduction in thickness of the ram rubber results in an ineffective seal, unless the ram block is moved forward slightly from its initially set, locked position. Readjustment requires turning the threaded ram shaft within the engaging threads in the ram piston to move the ram shaft and ram block forward slightly, to compensate for wear of the sealing element. This adjustment must result in a precisely controlled locking position, in which the ram rubber must seat sufficiently tightly against the wall of a drill string component to resist blowout pressures as high as 15,000 psi, yet not damage the drill string component. Usually, the skill required to make this adjustment, which may be as small as a fraction of a screw thread, necessitates flying out a factory-trained specialist to the drilling site, at a very considerable expense to the drill operator.

Ram blowout preventers of the type described above, in which a resilient sealing element is used to seal on a particular diameter drill string component, belong to a particular class of ram blowout preventers referred to as pipe ram blowout preventers or pipe rams. Another type of ram blowout preventer, referred to as a shear ram, shears off a drill pipe and effects a seal between the two severed halves. This type of blowout preventer also requires a very precise adjustment of its longitudinal locking position.

A third type of ram blowout preventer, referred to as a variable bore ram blowout preventer, is used to seal drill string components having a diameter which may vary over a substantially broad range. The structure and operation of variable bore blowout preventers is described in our disclosure of a novel variable bore ram rubber in our patent application entitled, "Variable Bore Ram Rubber" Granger, Beard and Sveen, filed Apr. 29, 1988, Ser. No. 188,267, now U.S. Pat. No. 4,930,745, issued June 5, 1990.

Each of the three types of ram blowout preventers described above requires a different adjustment procedure which must be performed by an experienced, highly skilled individual. The variable bore ram blowout preventer probably requires the most critical and demanding adjustment. For example, a typical variable bore ram blowout preventer is designed to accommodate drill string components in the diameter range of 3½ inches to 5 inches. Usually, if the locking position of the ram piston is adjusted so that the resilient ram rubber forms an effective seal against a 3½ inch pipe, the ram blowout preventer will not produce an effective seal against the surface of a 5 inch pipe, and vice versa. To counter this problem, ram blowout preventers have been manufactured which use a two-stage locking piston. However, these devices are extremely complicated and difficult to adjust, and have therefore not been widely used.

In view of the difficulties associated with the operation of ram blowout preventers described above, the self-adjusting automatic locking piston for ram blowout preventers according to the present invention was conceived of.

OBJECTS OF THE INVENTION

An object of the present invention is to provide a self-adjusting automatic locking piston for ram blowout preventers.

Another object of the invention is to provide a self-adjusting automatic locking piston which may be installed in the hydraulic cylinders of existing ram blowout preventers.

Another object of the invention is to provide an automatic locking piston for ram blowout preventers which securely locks the piston at a forward position in its longitudinal travel within a hydraulic cylinder, and maintains the piston at the locked position even in the absence of hydraulic pressure.

Another object of the invention is to provide an automatic locking piston which is capably of lockably engaging a hydraulic cylinder containing the piston over a continuously and automatically variable range of forward positions of the piston within the cylinder, and maintaining the locked position even in the absence of hydraulic pressure.

Various other objects and advantages of the present invention, and its most novel features, will become apparent to those skilled in the art by perusing the accompanying specifications, drawings and claims.

It is to be understood that although the invention disclosed herein is fully capable of achieving the objects and providing the advantages described, the characteristics of the invention described herein are merely illustrative of the preferred embodiment. Accordingly, we do not intend that the scope of our exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved ram blowout preventer of the type using a hydraulic ram piston which automatically locks at a pre-determined forward longitudinal position within a hydraulic cylinder slidably holding the piston. The improvement comprises a novel self-adjusting automatic locking piston which automatically lockingly engages a groove provided in the inner wall surface of a hydraulic cylinder, over a continuous range of forward positions of the piston within the cylinder, and maintains the locked position even if hydraulic pressure supplied to the cylinder is interrupted. The self-adjustment feature of the automatic locking piston according to the present invention constitutes a substantial advancement over prior art locking pistons, which have one or at most two discrete locking positions.

The novel self-adjusting, automatic locking piston for ram blowout preventers according to the present invention includes an outer cylindrical piston having a transversely disposed rear circular piston head, and a smaller diameter front boss section which is joined to the cylindrical piston wall by a tapered annular flange. The front boss section is internally threaded to engage the threads of an externally threaded ram rod which extends from the rear end of the piston forward through the boss section. The forward end of the ram rod is fastened to a ram block. Thus, the external appearance of the piston according to the present invention is substantially similar to that of automatic locking pistons of existing ram blowout preventers, allowing the piston according to the present invention to be installed in the hydraulic cylinder of an existing ram blowout preventer.

The self-adjusting automatic locking piston according to the present invention has a coaxial central bore which longitudinally slidably contains a smaller diameter, inner locking piston. The inner locking piston has a central bore which permits it to slide longitudinally on the ram shaft extending through it and the main piston body. The rear portion of the locking piston body is cylindrically shaped, while the front portion is generally frusto-conical in shape.

The conical wall surface of the inner piston is modified to have three identical, generally longitudinally disposed flat faces which extend rearward from the front circular face of the front end of the piston. The three flat faces intersect the rear cylindrical section of the inner locking piston slightly rearward of the intersection of the frusto-conic front section of the locking piston with its rear cylindrical section. The three flats are spaced apart at 120-degree circumferential angles, and have, at the front circular face of the locking piston, a circumferential width of approximately 70 degrees.

The outer, main piston body has three elliptically-shaped, circumferentially elongated, radially disposed apertures which extend radially inwards through the outer cylindrical wall surface of the main piston body into the longitudinal bore provided within the main piston for the smaller locking piston. The radially disposed apertures are positioned at 120-degree circumferential angles, centered on the same longitudinal planes as are the flats on the front of the inner locking piston. The radially disposed apertures in the main piston are located just rearward of the intersection of the rear cylindrical outer wall surface of the main piston with its frusto-conic front face.

Each radially disposed aperture has curved short, longitudinally disposed sides, and slidably contains a metal driver segment which has in plan-view the shape of a transversely elongated oval. In elevation-view, each driver segment has the shape of a block having an upwardly and rearwardly sloping planar lower surface, the slope of which matches one of the three sloped flats on the front face of the inner locking piston. The upper face of the driver segment slopes upwards and forwards from the rear edge of the driver segment. This slope matches the front to rear slope of the front bottom edge of the front portion of a locking segment or lug, the lower or radially inward end of which fits slidably in the radially disposed aperture in the main piston. The rear portion of each of the three locking segments has in plan-view the shape of a circumferentially elongated rectangular body of greater circumferential extent than that of the driver segments. The locking segment is adapted to fit within a correspondingly shaped, circumferentially elongated rectangular groove provided in the outer cylindrical wall surface of the main piston body. This groove is centered just rearward of and communicates with the rear portion of the radially disposed aperture entrance for the driver segment.

The front portion of the locking segment which has the sloping lower surface contacted by the driver segment is of smaller circumferential, or transverse, length than the rear portion. Thus, the overall plan-view shape of the locking segment is that of a TEE. The upper, or radially outward surface of the rear portion of the locking segment is curved complementarily to the curved inner wall surface of the cylinder containing the piston.

When the main piston and inner locking piston are driven forward by closing hydraulic pressure, each of the three sloping flat surfaces on the front of the locking piston slidably engages the lower inclined surface of a separate driver segment, moving the driver segment radially outwards. The upper and forward sloping upper surfaces of each driver segment in turn slidingly contacts the lower and rearward sloping surfaces of the front portion of each of the three locking segments, forcing each locking segment radially outwards. When the main piston has moved forward sufficiently for the outer, enlarged portion of each locking segment to underlie an annular groove provided in the inner cylindrical wall surface of the hydraulic cylinder, the locking segments are driven radially outwards into the groove. Thus positioned, the rear, upper edge wall of each locking segment abuts the rear transverse edge wall, or shoulder, of the annular cylinder groove. This locks the main piston within the cylinder at a fixed longitudinal position, even if hydraulic pressure is removed.

If the ram shaft and attached main piston travel forward a greater distance, as a result of closing on a smaller diameter pipe, or wear of the ram rubber, the enlarged rear portions of the locking segments are free to slide rearward within the rectangular grooves in the outer surface of the large piston. This rearward motion is accompanied by forward motion of the inner locking piston relative to the main piston, and upward motion of the driver segments. Thus, the main piston is still securely locked at more forward positions. The excess of the longitudinal length of the main piston rectangular grooves over the longitudinal length of the locking segments may be any desired value, but typically could be approximately one inch. Thus, the novel self-adjusting automatic locking piston according to the present invention is capable of automatically locking, in a closed position of a BOP, over a continuous range of one inch travel.

DETAILED DESCRIPTION OF THE INVENTION

Referring now to FIGS. 1 through 13, a novel self-adjusting automatic locking piston for ram blowout preventers according to the present invention is shown.

Figure 1:
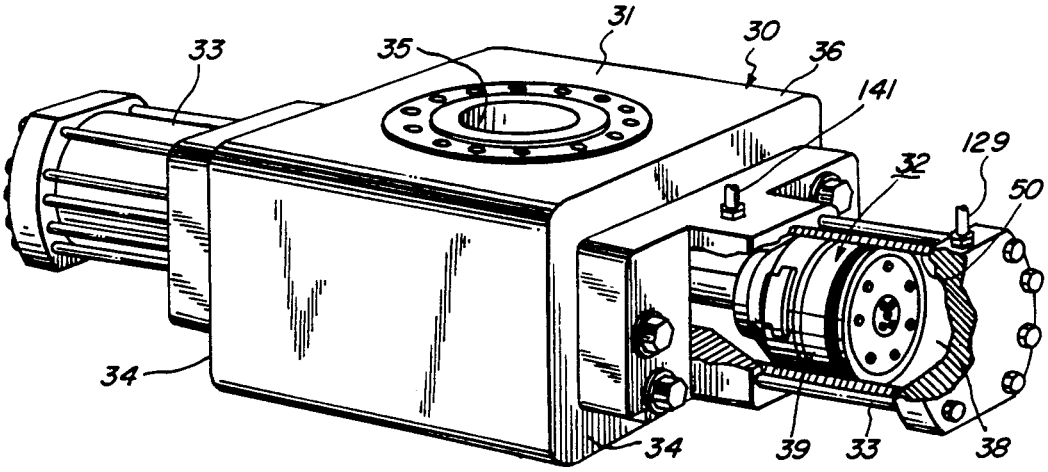
FIG. 1 is a partially sectional view of a ram blowout preventer employing the self-adjusting automatic locking piston according to the present invention.

FIG. 1 illustrates a conventional ram blowout preventer 30 having a housing 31 which utilizes a pair of the novel self-adjusting automatic locking pistons 32 according to the present invention. Housing 31 of ram blowout preventer 30 has the general appearance of a large rectangular box having a pair of diametrically opposed hydraulic cylinders 33 extending perpendicularly outwards from opposite vertical side walls 34 of the housing. An aperture 35 extends longitudinally through the housing, coaxial with a vertical center line of the upper horizontal wall 36 of the housing 31. Aperture 35 is provided to receive vertical drill string components such as the length of pipe 37, as shown in FIG. 2.

Each hydraulic cylinder 33 of the ram blowout preventer has a bore 38 which slidably contains a generally cylindrically shaped self-adjusting automatic locking piston 32 according to the present invention. As may be seen best by referring to FIGS. 3 through 6, self-adjusting automatic locking piston 32 includes an outer piston 39. Outer piston 39 has a generally cylindrically shaped body 40 and a transversely disposed, rear circular piston head 41. Piston 39 also has a smaller diameter front cylindrical boss section 42 of smaller diameter than body 40, and joined thereto by a tapered annular flange section 43 of generally frusto-conic shape.

Figure 2:
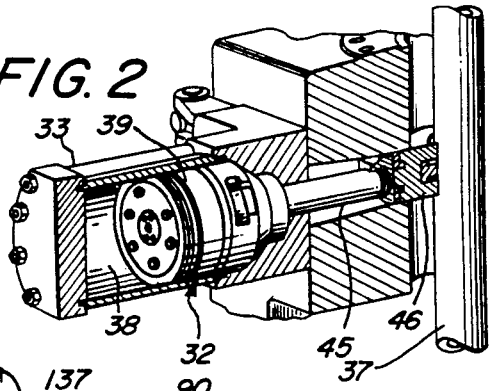
FIG. 2 is a fragmentary longitudinal sectional view of the apparatus of FIG. 1, showing the locking piston advanced to a locking position.
Figure 6:
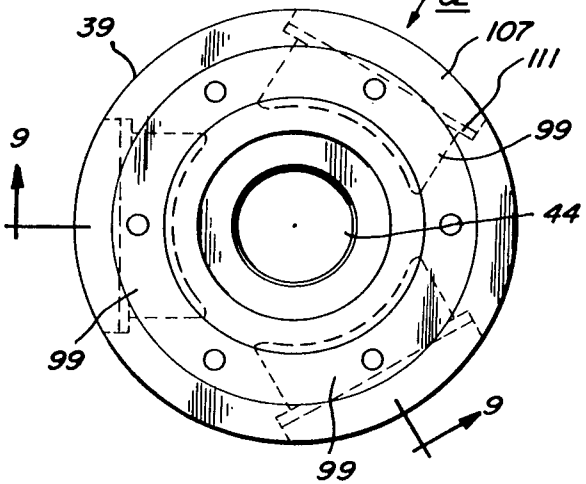
FIG. 6 is a front end elevation view of the device of FIG. 3.
Figure 5:
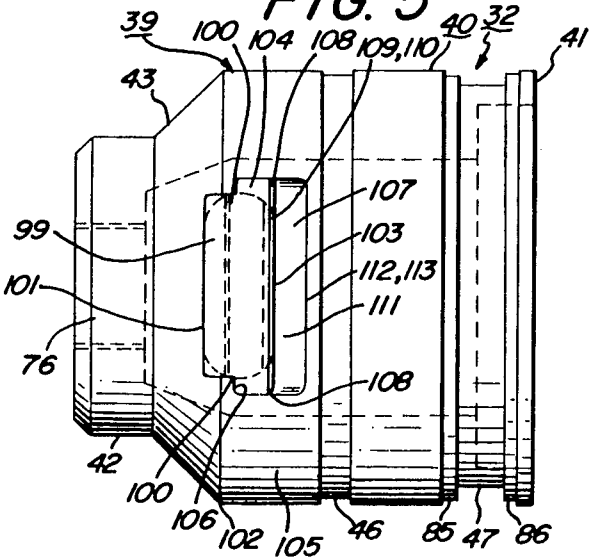
FIG. 5 is a side or upper elevation view of the device of FIG. 3.

As shown in FIGS. 2 and 6, front boss section 42 of outer piston 39 is provided with a coaxial bore 44 for receiving a ram rod 45 which extends back from a ram block 46. Ram rod 45 is securely fastened to main outer piston 39 in a manner described below. Referring to FIG. 5, it may be seen that body 40 of outer piston 39 contains in its outer cylindrical wall surface front and rear annular grooves 46 and 47, respectively. Grooves 46 and 47 are provided to receive sealing wear ring 48 and piston ring 49, respectively, for making a fluid pressure-tight seal with the inner cylindrical wall surface 50 of hydraulic cylinder 33.

It will be recognized by those skilled in the art that piston 32, as described above, has the proper external shape or form factor to be installed in the hydraulic cylinders of many existing ram blowout preventers, as a replacement or "retrofit" for an existing locking piston.

Figure 7:
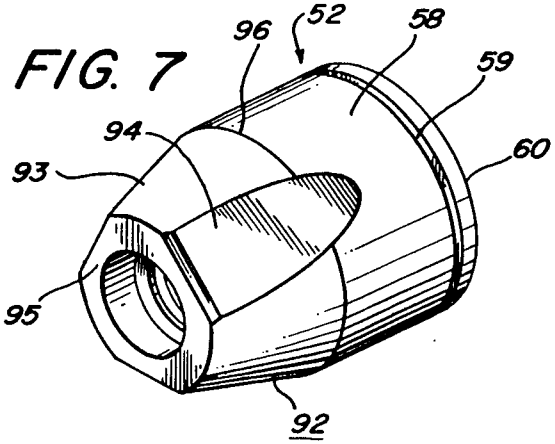
FIG. 7 is a front perspective view of an inner locking piston forming part of the device of FIG. 3.
Figure 8:
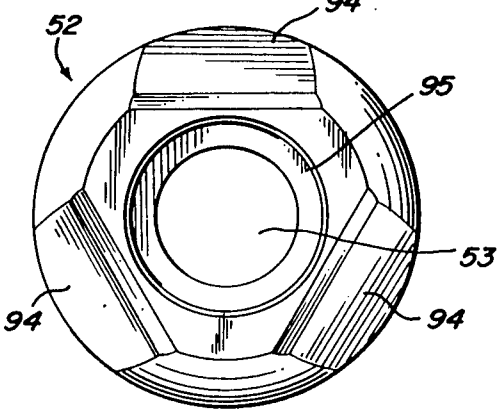
FIG. 8 is a front end elevation view of the device of FIG. 7.
Figure 9:
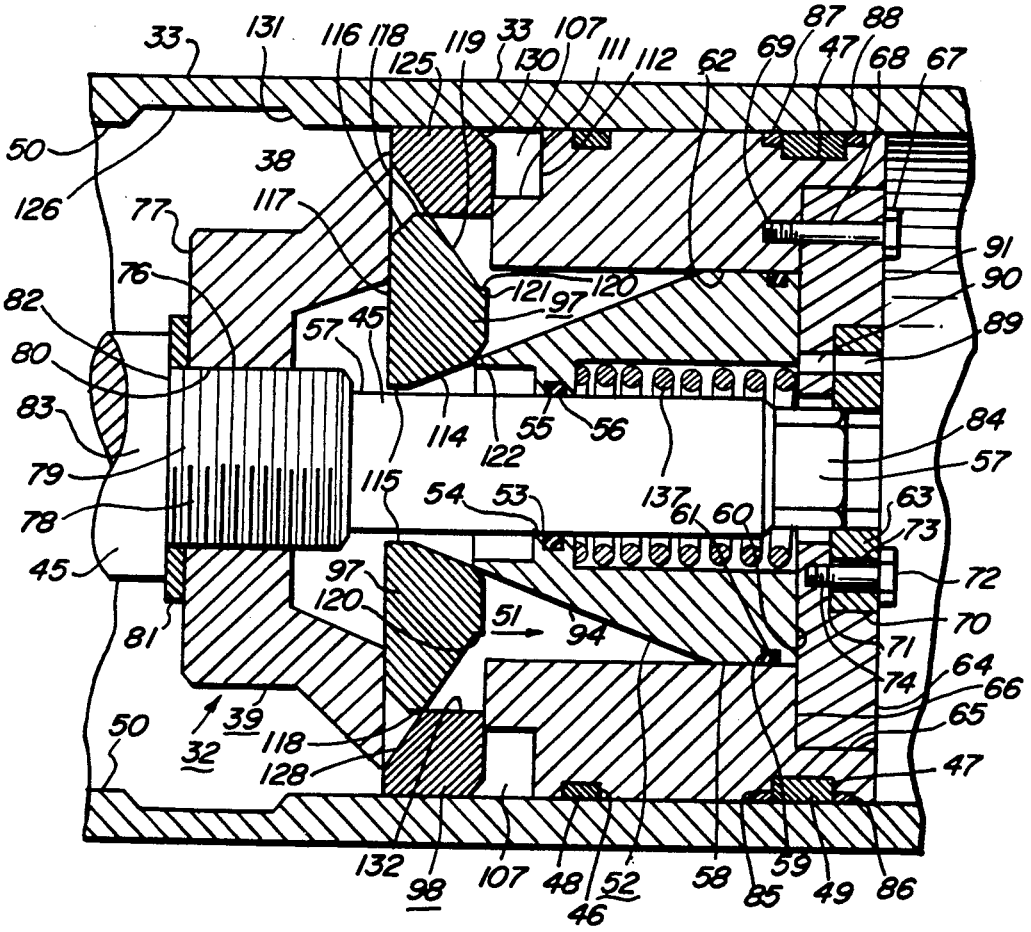
FIG. 9 is a medial longitudinal sectional view of the device of FIG. 3, showing the device installed in the hydraulic pressure cylinder of a ram blowout preventer of the type shown in FIG. 1, with the device in a fully retracted, unlocked position.

Referring now especially to FIG. 9, it may be seen that main, outer piston 39 has a central coaxial bore 51 which longitudinally slidably contains a smaller diameter, inner, locking piston 52. As shown in FIGS. 7, 8 and 9, inner locking piston 52 has central coaxial bore 53, which allows the inner locking piston to slide longitudinally on ram shaft 45 extending through the bore. The inner cylindrical wall surface 54 of inner piston 52, adjacent bore 53, is provided with an annular groove 55. Groove 55 is adapted to receive an internal piston ring or seal 56. Seal 56 allows piston 52 to move longitudinally with respect to ram rod shaft 45, while maintaining a fluid pressure-tight seal between the inner periphery of the seal and the outer circumferential wall surface 57 of the ram rod shaft.

Figure 12:
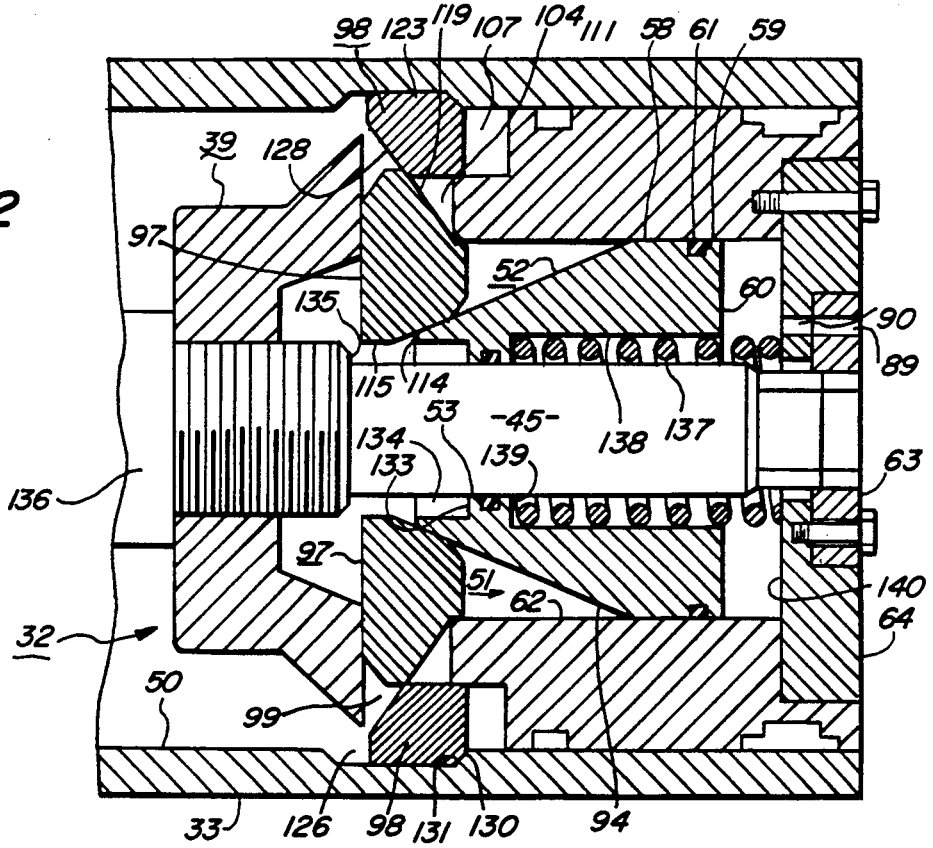
FIG. 12 is a sectional view similar to FIG. 9, but showing the device of FIG. 3 fully locked at the beginning, or rear limit, of its longitudinal locking range.

As shown in FIG. 7, the rear portion 58 of inner piston 52 is cylindrically shaped. As shown in FIGS. 9 and 12, rear cylindrical portion 58 of inner piston 52 is of slightly smaller outer diameter than the diameter of bore 51 of outer piston 39, allowing the inner piston to move longitudinally with respect to the outer piston. An annular groove 59 is provided in the cylindrical wall surface of rear cylindrical portion 58 of inner piston 52, near rear annular piston head face 60 of the inner piston. Groove 59 is adapted to receive an external piston ring or seal 61. Seal 61 maintains a fluid pressure-tight seal between the exterior surface of the rear cylindrical portion 58 of inner piston 52 and the inner cylindrical wall surface 62 of bore 51 of large piston 39.

Figure 4:
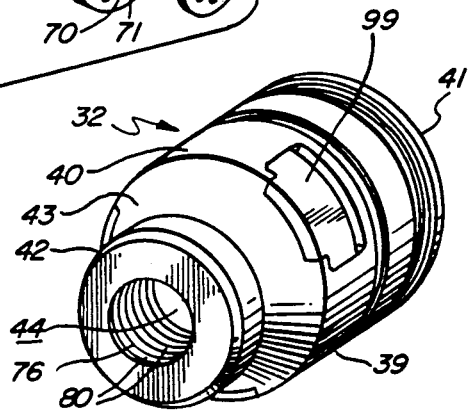
FIG. 4 is a front perspective view of the device of FIG. 3.

As may be seen best by referring to FIGS. 4 and 9, inner piston 52 is secured within bore 51 of outer piston 39 by means of locking plate 63 and end plate 64. End plate 64 is circular, and adapted to fit within a countersunk bore 65 provided in the rear face of large piston 39. End plate 64 seats on an annular flange 66 defining the inner end of bore 65, and is secured there by means of bolts 67 screwed through holes 68 in the end plate and holes 69 in the flange.

Similarly, locking plate 63 has a circular outer surface, and is adapted to fit within a countersunk bore 70 provided in the rear face of end plate 64. Locking plate 63 seats on an annular flange 71 defining the inner end of bore 70, and is secured there by means of bolts 72 screwed through holes 73 in the locking plate into blind threaded holes 74 in end plate 64.

Figure 10:
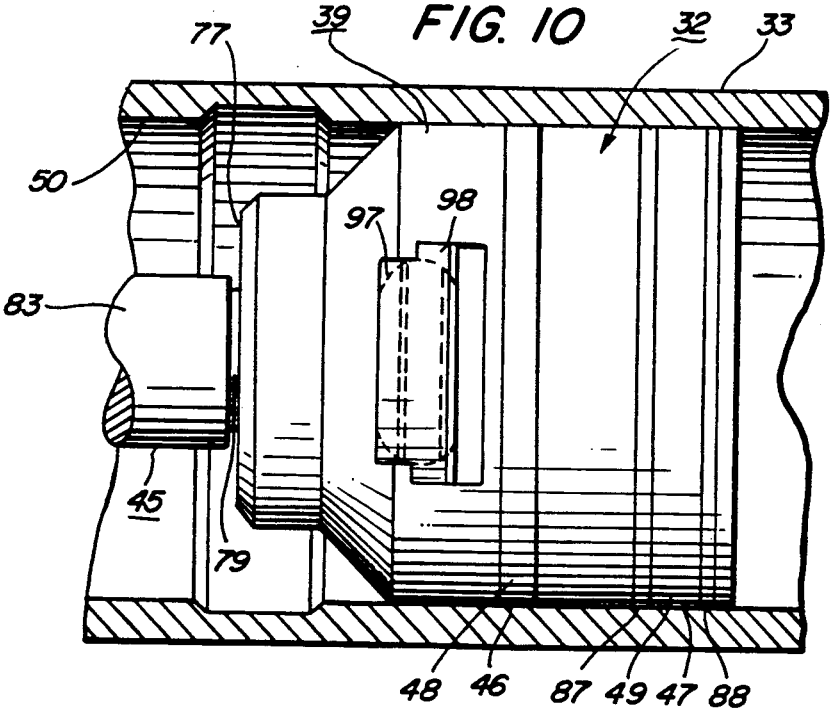
FIG. 10 is a partly sectional upper plan-view of the apparatus of FIG. 9, showing the hydraulic cylinder in section.

As may be seen best by referring to FIGS. 9 and 10, ram rod shaft 45 passes through a central coaxial hole 76 provided in the front face 77 of large outer piston 39. Shaft 45 is secured to outer piston 39 by means of external helical threads 78 on the outer surface of a reduced diameter portion 79 of the shaft, which threads engage internal helical threads 80 on the inner wall surface of hole 76 in the piston. Ram rod shaft 45 is positioned in a desired longitudinal position with respect to outer piston 39 by means of a shim washer 81 of selected thickness, positioned between front face 77 of the piston and an annular flange 82 comprising the intersection between reduced diameter portion 79 and main portion 83 of the shaft. Selected shim washer 81 is placed on section 79 of shaft 45 prior to screwing the reduced diameter section of the shaft into threaded hole 76 of the outer piston.

As shown in FIG. 9, the inner end 84 of shaft 45 has a hexagonal external transverse cross-sectional shape. Locking plate 63, as may be seen best by referring to FIGS. 3 and 9, has a coaxial bore 63A of hexagonal cross-section of the proper size and shape to receive hexagonal inner end 84 of shaft 45. Thus, when locking plate 63 is bolted to end plate 64, ram rod shaft 45 is prevented from rotating with respect to outer piston 39, maintaining the pre-set longitudinal extension of the ram rod shaft relative to outer piston 39.

As may be seen best by referring to FIGS. 5 and 9, rear annular groove 47 of main piston 39 contains a piston ring 49 which is adapted to form a fluid pressure-tight seal, whether cylinder 33 is pressurized from the right, for a closing actuation of piston device 32, or from the left, for an opening actuation of the piston. Groove 47 contains front and rear step flanges 85 and 86 for front and rear wear bands 87 and 88, respectively. The function of rear wear bands 87 and 88, and front wear ring 48 is to prevent cocking of piston 39 with respect to bore 38 of cylinder 33, thereby protecting both piston and bore from scuffing.

Figure 3:
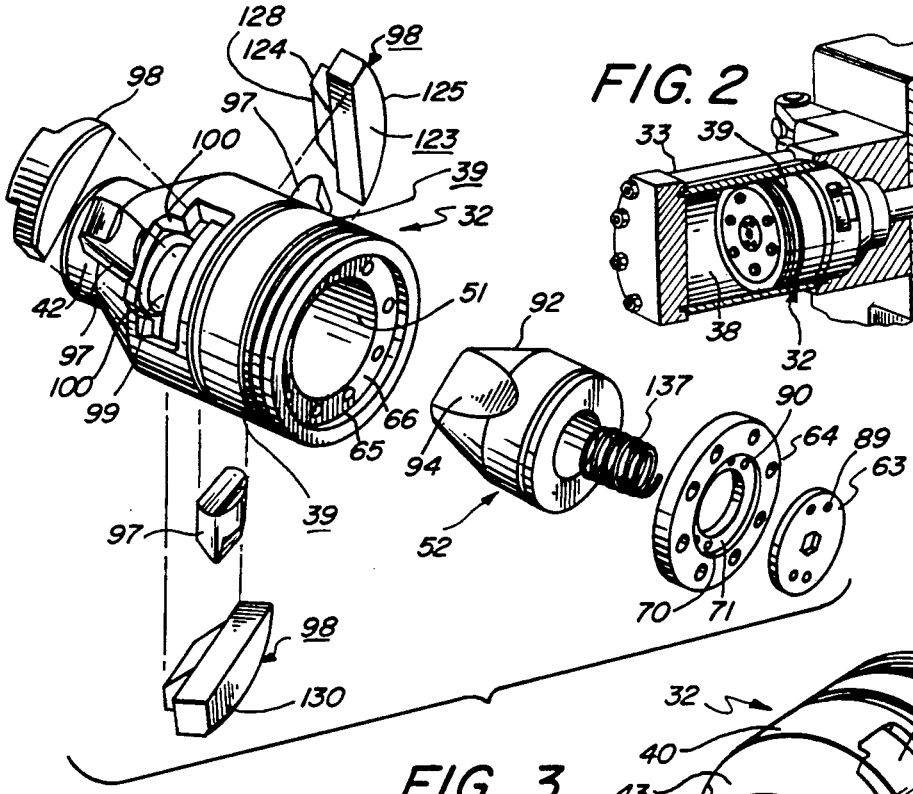
FIG. 3 is an exploded view of the self-adjusting automatic locking piston of FIG. 1 according to the present invention.
Figure 13:
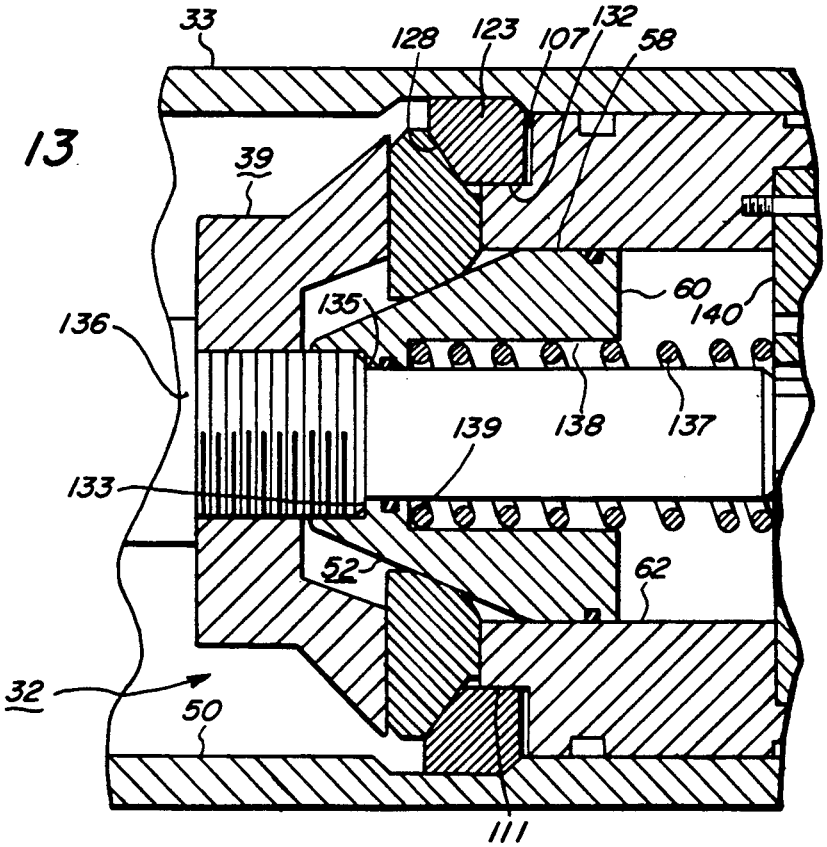
FIG. 13 is a sectional view similar to FIG. 9, but showing the device of FIG. 3 fully locked at the front end, or forward limit, of its longitudinal locking range.

As shown in FIGS. 3 and 9, registered fluid pressure holes 89 and 90 are provided through the thickness dimension of locking plate 63 and end plate 64, respectively. Fluid pressure holes 89 and 90 allow pressurized hydraulic fluid on the right hand side 91 of piston device 32 to enter the region between the inner face of end plate 64 and the rear annular face 60 of internal piston 52. Pressurized fluid in that region is used to drive inner piston 52 leftwards with respect to outer piston 39, as shown in FIGS. 12 and 13, and as will be described in detail below.

As may be seen best by referring to FIGS. 3, 7 and 8, inner piston 52 has a generally frusto-conically shaped front portion 92. Conical wall surface 93 of front portion 92 is modified to have three identical, generally longitudinally disposed flat faces or flats 94 which extend rearward from front annular face 95 of inner piston 52. Flats 94 intersect rear cylindrical section 58 of inner piston 52 slightly rearward of the circular intersection 96 of front section 92 of the inner piston with the rear cylindrical section. Flats 94 are spaced apart at 120-degree circumferential angles, and have at the front annular face 95 of inner piston 52, a circumferential width of approximately 70 degrees. As shown in FIGS. 7 through 9, flats 94 slope upward and rearward from front annular face 95 of piston 52. Thus, as will be described in detail below, flats 94 function as inclined planes which force driver segments 97 and locking segments 98 radially outwards when inner piston 52 moves longitudinally forward within outer piston 39.

As shown in FIGS. 3 through 6, outer or main piston 39 has three identical radially disposed apertures 99 which extend through the outer wall surface of the piston into bore 51 of the main piston. In plan view, each of the apertures 99 has a generally rectangular shape, with long front and rear lateral edge walls parallel to a plane transverse to the longitudinal axis of generally cylindrically shaped outer piston 39, and symmetrically shaped curvilinear short longitudinal edge walls 100. Apertures 99 are spaced apart at 120-degree circumferential angles. The front long lateral edge wall 101 of each aperture penetrates tapered annular flange section 43 of outer piston 39 slightly forward of intersection plane 102 between the annular flange section and cylindrical front boss section 42 of the outer piston. Rear long lateral edge wall 103 of aperture 99 penetrates cylindrical wall 105 of outer piston 39 further away from intersection plane 102 than does front long edge wall 101. Thus, most of the longitudinal extent of each aperture 99 is located in cylindrical body 40 of outer piston 39.

As may be seen best by referring to FIG. 5, a relatively deep rectangular groove 104, whose long axis is also circumferentially or transversely disposed, like that of aperture 99, is cut into outer cylindrical wall surface 105 of cylindrical body 40 of outer piston 39, adjacent each aperture 99. The front edge wall 106 of deep groove 104 is approximately coincident with the trace of a transverse plane bisecting each aperture 99, and extends circumferentially a short distance beyond each short edge 100 of the aperture.

Located rearward of each of the three deep rectangular grooves 104 is a shallower circumferentially elongated rectangular groove 107. Groove 107 is substantially similar in plan view shape and size to deep groove 104, and shares common short edge wall traces 108 therewith. Front edge 109 of shallow rear groove 107 is common with rear edge 110 of deep front groove 104. As may be seen best by referring to FIGS. 5, 6 and 9, the bottom, or radially innermost wall 111 of shallow groove 107 perpendicularly intersects rear wall surface 112 of the shallow groove forming a ledge which extends rearwards from front edge 109 of the shallow groove to rear wall 112.

As may be seen best by referring to FIGS. 3 and 9, each radially disposed aperture 99 has curved, short longitudinally disposed short sides 100, and radially slidably contains a metal driver segment 97. Each driver segment 97 has in plan view the shape of a transversely elongated oval. As shown in FIG. 9, driver segment 97 has in elevation sectional view the shape of a polygonal block. Thus, driver segment 97 has a radially outwardly and rearwardly sloping bottom wall 114. The shape and slope of bottom wall 114 of driver segment 97 is complementary to that of a flat 94 of inner piston 52, on which the bottom wall is slidable with respect thereto.

Bottom sloping wall 114 of driver segment 97 intersects a relatively short, horizontally disposed bottom flat 115. The upper surface of driver segment 97 has a relatively short flat face 116 which slopes upwards and rearwards from flat front face 117 of the segment, and a very short, horizontally disposed top face 118. A substantially long upper face 119 slopes downwardly and rearwardly from top face 118. Downwardly and rearwardly sloping face 119 terminates at a substantially short horizontal ledge face 120. A vertically disposed rear face 121 extends downwards from ledge face 120, and terminates in a short, downwardly and forwardly sloping beveled face 122. Beveled face 122 terminates at the rear edge of bottom sloping wall 114. Downwardly and rearwardly sloping upper face 119 is adapted to slidably engage a complementarily shaped face of locking segment 98, the details of which locking segment will now be described.

As may be seen best by referring to FIGS. 3 and 9, each locking segment 98 has a rectangular plan view rear groove-engaging portion 123 and a front guide boss section 124. Rear groove-engaging portion 123 of locking segment 98 has a generally rectangular plan view shape which is adapted to fit within adjacent front deep groove 104 and shallow rear groove 107 in outer piston 39, and move radially inwards and outwards within the adjacent grooves. The outer, or upper wall 125 of locking segment 98 has in rear or transverse view the shape of a segment of a circular arc. Thus contoured, upper wall 125 is adapted to move radially outwards into locking engagement with an annular groove 126 in inner cylindrical wall surface 50 of hydraulic cylinder 33.

As shown in FIGS. 3 and 10, front guide boss section 124 of locking segment 98 has an oval plan view shape adapted to move radially in and out within aperture 99. The lower surface 128 of front guide boss section 124 slopes downwardly and rearwardly, and is adapted to slide on downwardly and rearwardly sloping upper long face 119 of driver segment 97.

The operation of self-adjusting automatic locking piston 32 according to the present invention may best be described by reference to FIGS. 9 through 13.

Figure 11:
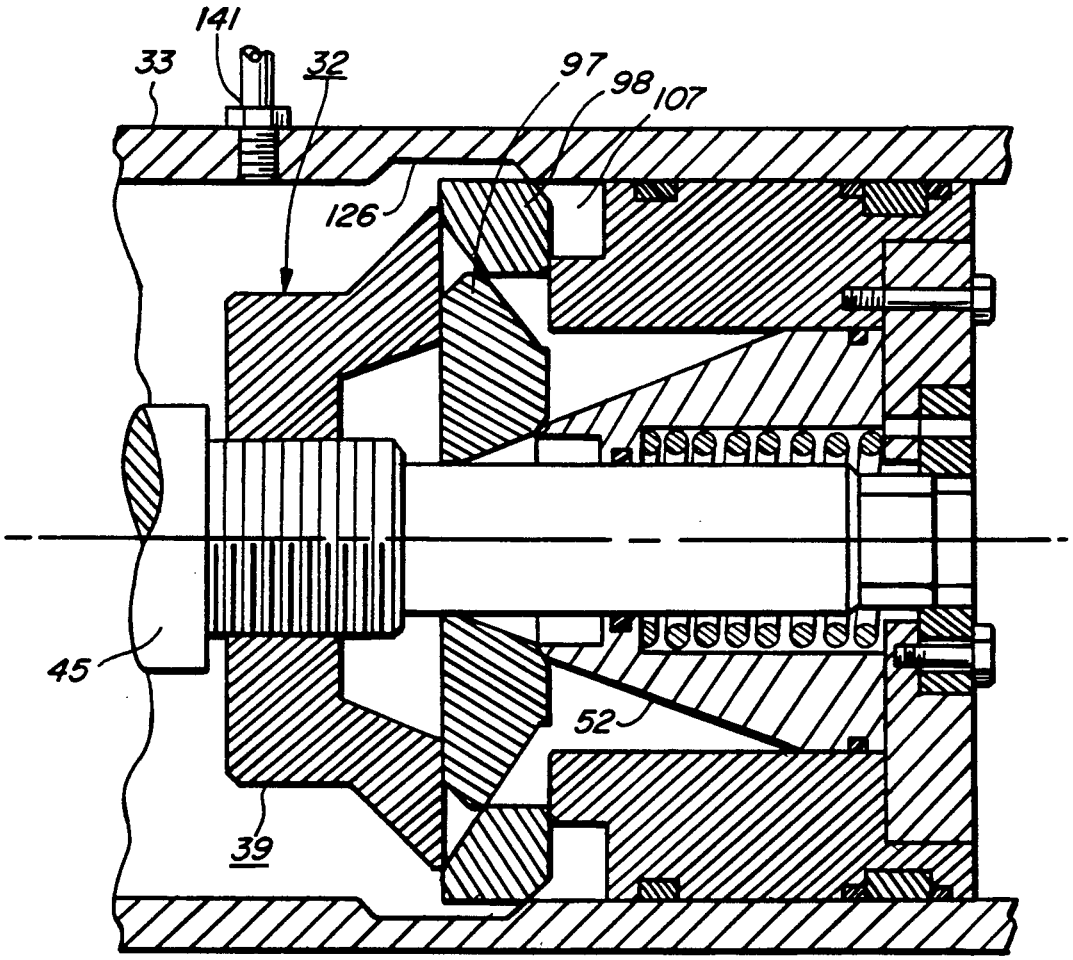
FIG. 11 is a sectional view similar to FIG. 9, but showing the device of FIG. 3 positioned just rearward of the beginning of its locking range.

FIGS. 9 and 10 show piston 32 fully retracted within hydraulic cylinder 33. FIG. 11 shows piston 32 having been moved leftward towards a closing or sealing position within hydraulic cylinder 33, in response to pressurization by hydraulic fluid of the right hand side 91 of piston 32 via closing hydraulic fluid inlet port 129. FIG. 12 shows piston 32 fully locked at the beginning, or rear limit of its longitudinal locking range. In this position, hydraulic fluid under pressure has passed through fluid pressure holes 89 in locking plate 63 and though aligned fluid pressure holes 90 in end plate 64 to impact rear annular face 60 of inner piston 52, forcing the inner piston to move leftwards within bore 51 of outer piston 39. This movement causes driver segments 97, whose lower upward and rearwardly sloping faces 114 are in sliding contact with downward and forward sloping faces 94 of inner piston 52, to move upward within apertures 99. Upward movement of driver segments 97, in turn, causes locking segments 98, each of whose lower downwardly and rearwardly sloping wall 128 of front guide boss section 124 of the locking segment is in slidable contact with downwardly and rearwardly sloping long upper face 119 of a driver segment, to move radially outwards within adjacent grooves 104 and 107 of outer piston 39. At this position, the upper rear beveled wall 130 of rear groove-engaging rear portion 123 of locking segment 98 slidingly engages rear beveled edge wall or shoulder 131 of groove 126 in the inner wall 50 of hydraulic cylinder 33, facilitating entry of the rear portion of the locking segment into locking engagement of the groove.

FIG. 13 shows both inner piston 52 and outer piston 39 having travelled the maximum allowable distance forward within hydraulic cylinder 33, i.e., at the front end or forward limit of the longitudinal locking range of device 32. Comparing FIG. 13 with FIG. 12, it may be seen that in the limiting position of FIG. 13, rear groove-engaging portion 123 of locking segment 98 has remained in a fixed position relative to annular groove 126 in cylinder 33, but bottom wall 111 of shallow groove 107 in outer piston 39 has slid forward on bottom horizontal face 132 of the groove engaging portion.

As shown in FIGS. 12 and 13, with the inner piston 52 moved forward to the limit of its travel, an annular flange 133 at the bottom of a counterbored entrance hole 134 in the front face of the inner piston abuts a flange surface 135 of threaded section 136 of ram rod shaft 45. Inner piston 52 is maintained in a fixed longitudinal position relative to outer piston 39, and therefore relative to ram rod shaft 45 as well, by the action of a compression spring 137. Compression spring 137 is contained within a counterbore 138 in rear face 60 of inner piston 52. Spring 137 spans the distance between annular flange 139 at the bottom of counterbore 138, and the inner wall 140 of end plate 64. Thus, even if there is a complete failure of hydraulic pressure at closing hydraulic inlet port 129, ram shaft 45 will remain in locked position over the entire adjustment range of approximately one inch depicted in FIGS. 12 and 13. Spring 137 also ensures that vibration will not cause inner piston 52 to creep out of position within outer piston 32 when in a locked position, even with no hydraulic closing pressure.

To retract ram rod shaft 45 to an unlocked position, hydraulic pressure is removed from closing hydraulic inlet port 129 and applied to opening hydraulic inlet port 141. Opening hydraulic pressure applied to the left hand side of inner piston 52 moves the inner piston rightwards with respect to outer piston 39. Motion of inner piston 52 relative to outer piston 39, in turn, permits driver segments 97 and locking segments 98 to move radially inwards sufficiently far for the locking segments to become disengaged from annular groove 126 in inner wall 127 of hydraulic cylinder 33, thus permitting the outer piston to move rightwards to a fully retracted position, as shown in FIG. 9.

What is claimed is:

1. A hydraulic piston for use in a hydraulic cylinder having an internal annular groove adapted to receive locking segments or dogs for retaining a hydraulic piston at a fixed longitudinal position within said cylinder, said hydraulic piston being characterized by being automatically lockable at a self-adjusting range of forward positions from a rearward groove-engaging locked position, said self-adjusting automatic locking piston comprising;

a. an outer, hollow main piston of generally cylindrical shape having a rear cylindrical body, a transversely disposed rear circular piston head, a smaller diameter cylindrically-shaped front boss section, and a tapered intermediate annular section joining said rear and front sections, said outer piston including means for fastening thereto a piston rod, a coaxial bore and a plurality of radially disposed apertures through the outer wall surface of said outer piston and communicating with said coaxial bore, and a plurality of circumferentially elongated grooves cut inwards from the outer cylindrical wall surface, one each groove communicating with the rear end of each aperture, b. an inner locking piston having a generally cylindrical rear section and a tapered front section longitudinally slidably contained within said coaxial bore of said main outer piston, said inner locking piston having a central coaxial bore adapted to slidably receive said piston rod, c. a plurality of driver segments, one each of said driver segments radially slidably located within a separate one of each of said radially disposed apertures through the outer surface of said main outer piston, each of said driver segments having a sloping lower wall surface adapted to slidable engagement by said tapered front surface of said inner locking piston, whereby forward motion of said inner locking piston within said main outer piston forces each of said driver segments to move radially outwards within said aperture, each of said driver segments having a sloping upper rear surface, and d. a plurality of locking segments, one each radially slidably positioned in each of said grooves in the outer cylindrical wall surface of said main outer piston, each of said locking segments including a rear portion having an outer surface adapted to engage the inner wall surface of said annular groove in said inner wall surface of said hydraulic cylinder, and each of said locking segments including a narrower front section having a sloping lower front surface adapted to slidable engagement by said sloping upper rear surface of said driver segment, whereby radial outward motion of each of said driver segments forces each of said locking segments radially outwards into locking engagement with said annular cylinder groove.

2. The self-adjusting, automatic locking piston of claim 1 wherein the longitudinal extent of each of said grooves in said outer wall of said main outer piston is greater than the longitudinal extent of said rear portion of said locking segment, whereby said locking segment may move longitudinally rearward in said groove, thereby allowing said driver segment to move radially outwards a greater distance, and thereby allowing said inner locking piston, said outer main piston and said piston rod to move forward within said cylinder relative to said annular groove in said inner wall surface of said cylinder.

3. The self-adjusting automatic locking piston of claim 2 wherein said tapered front surface of said inner locking piston is further defined as comprising a frusto-conic annular surface, modified to have a plurality of generally longitudinally disposed flat faces, one each for each of said driver segments, said flat face being of the proper size and shape to engage said sloping lower wall surface of said driver segment.

4. The self-adjusting automatic locking piston of claim 3 wherein said plurality of flat faces on said frusto-conic surface of said inner locking piston is further defined as three identical faces spaced apart at 120-degree circumferential angles.

5. The self-adjusting automatic locking piston of claim 4 wherein each of said radially disposed apertures provided through the outer wall surface of said outer piston for said driver segments is further defined as having a generally rectangular plan view shape, with longer front and rear lateral edge walls parallel to a plane transverse to the longitudinal axis of said piston.

6. The self-adjusting automatic locking piston of claim 5 wherein each of said grooves provided in said outer wall of said outer piston for said locking segments is further defined as having a generally rectangular plan view shape, with a longer rear lateral edge wall parallel to and symmetrically positioned with respect to said lateral edge walls of an adjacent one of said apertures, and a front lateral edge wall which is pierced by said aperture, at a position approximately midway between said front and rear lateral edge walls of said aperture, thereby forming with said aperture a T-shaped cut in said outer wall surface of said outer piston.

7. The self-adjusting automatic locking piston of claim 6 wherein each of said locking segments is further defined as having a generally T-shaped plan view, the capital of said T being adapted to be radially and longitudinally movable within said groove in said outer wall surface of said outer locking piston, and the upright portion of said T being adapted to move radially within said aperture.

8. The self-adjusting automatic locking piston of claim 7 wherein said transversely disposed rear circular piston head of said outer main piston has a countersunk circular coaxial opening forming at the bottom thereof an annular flange surrounding the rear end of said coaxial cylindrical bore provided within said main outer piston for slidably containing said inner locking piston, and an annular end plate seated on said annular flange and fastened to said outer piston, said end plate having a coaxial bore therethrough of smaller diameter than that of the rear cylindrical portion of said inner locking piston, thereby retaining said inner locking piston within said outer piston.

9. The self-adjusting automatic locking piston of claim 8 wherein the rear annular face of said annular end plate has a countersunk circular coaxial opening forming at the bottom thereof an annular flange, and a circular disc-shaped locking plate seated on said annular flange and fastened to said end plate.

10. The self-adjusting automatic locking piston of claim 9 wherein said locking plate is provided through its thickness dimension with an aperture adapted to receive the rear end of a piston rod extending rearward therethrough.

11. The self-adjusting automatic locking piston of claim 10 wherein said aperture through said locking plate has at least one flat surface adapted to engage a flat surface of said piston rod, thereby preventing rotation of said piston rod relative to said locking plate.

12. The self-adjusting automatic locking piston of claim 10 wherein said locking plate and said end plate are provided with aligned apertures disposed longitudinally through the thickness dimensions of each of said plates, thereby providing pathways for pressurized hydraulic fluid.

13. The self-adjusting automatic locking piston of claim 12 wherein said rear portion of each of said locking segments is further defined as having in transverse view a convexly curved outer surface adapted to conformally engage said inner wall surface of said annular groove of said hydraulic cylinder.

* * * * *